US007726651B2

(12) United States Patent
Böttger et al.

(10) Patent No.: US 7,726,651 B2
(45) Date of Patent: Jun. 1, 2010

(54) APPARATUS FOR EJECTING SHEETS

(75) Inventors: Andreas Böttger, Heidelberg (DE); Andreas Detmers, Heddesheim (DE); Peter Förch, Neustadt (DE); Edmund Klein, Neckargemünd (DE); Oliver Lang, Sandhausen (DE); Sven Lippardt, Wolfenbuettel (DE); Markus Möhringer, Weinheim (DE); Patrick Roth, Kandel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 184 days.

(21) Appl. No.: 12/030,894

(22) Filed: Feb. 14, 2008

(65) Prior Publication Data

US 2008/0191414 A1 Aug. 14, 2008

(30) Foreign Application Priority Data

Feb. 14, 2007 (DE) ..... 10 2007 007 280

(51) Int. Cl.
*B65H 39/10* (2006.01)

(52) U.S. Cl. ..... 271/303; 271/69; 271/300

(58) Field of Classification Search ..... 271/204, 271/300, 303, 69, 301, 302, 299, 280
See application file for complete search history.

(56) References Cited

U.S. PATENT DOCUMENTS

| | | | | |
|---|---|---|---|---|
| 3,106,393 | A * | 10/1963 | Koch | 271/279 |
| 3,284,081 | A * | 11/1966 | Huck | 271/300 |
| 4,235,434 | A * | 11/1980 | Muller | 271/280 |
| 6,000,695 | A * | 12/1999 | Mack et al. | 271/303 |
| 6,641,133 | B2 * | 11/2003 | Mutschall et al. | 271/204 |
| 6,659,453 | B2 * | 12/2003 | Kelm et al. | 271/183 |
| 2002/0140166 | A1 * | 10/2002 | Kelm et al. | 271/300 |
| 2006/0011078 | A1 * | 1/2006 | Beitel et al. | 101/232 |

FOREIGN PATENT DOCUMENTS

| | | |
|---|---|---|
| DE | 40 41 268 A1 | 6/1992 |
| DE | 198 19 491 C1 | 9/1999 |
| DE | 203 13 394 U1 | 11/2003 |
| DE | 10 2005 004 881 A1 | 8/2006 |
| GB | 2 336 837 A | 11/1999 |

* cited by examiner

*Primary Examiner*—Kaitlin S Joerger
(74) *Attorney, Agent, or Firm*—Laurence A. Greenberg; Werner H. Stemer; Ralph E. Locher

(57) ABSTRACT

An apparatus for ejecting sheets from a sheet transport path onto an auxiliary stack disposed upstream of a main stack, includes a planar sheet guide surface having a sheet ejection opening formed therein. The sheet ejection opening is closed by a sheet separating element and a flap, in a closed state. The separating element and the flap also serve as guide elements during the ejection of sheets.

7 Claims, 5 Drawing Sheets

APPARATUS FOR EJECTING SHEETS

CROSS-REFERENCE TO RELATED APPLICATION

This application claims the priority, under 35 U.S.C. §119, of German Patent Application DE 10 2007 007 280.7, filed Feb. 14, 2007; the prior application is herewith incorporated by reference in its entirety.

BACKGROUND OF THE INVENTION

Field of the Invention

The invention relates to an apparatus for ejecting sheets from a sheet transport path and, in particular, depositing the sheets on an auxiliary deposit stack disposed upstream of a main deposit stack.

German Patent DE 198 19 491 C1, corresponding to UK Patent Application GB 2 336 837 A, shows an auxiliary stack for the deposition of reject sheets, which is disposed upstream of a main sheet stack, in a sheet transport direction. In order to eject the sheets onto the reject stack, a drum having gripper devices picks up the sheet from a sheet conveyor system and conveys it onto the reject stack at machine speed. The speed of deposition is very high, so that the formation of a good stack cannot be achieved.

BRIEF SUMMARY OF THE INVENTION

It is accordingly an object of the invention to provide an apparatus for ejecting sheets onto an auxiliary stack for further processing, which overcomes the hereinafore-mentioned disadvantages of the heretofore-known devices of this general type.

With the foregoing and other objects in view there is provided, in accordance with the invention, an apparatus for ejecting sheets from a sheet transport path. The apparatus comprises a sheet deposit stack, a sheet discharge system for transporting the sheets to the sheet deposit stack, and a sheet guide device with an ejection opening formed therein. The sheet guide device has a flap and a separating element in the region or vicinity of the ejection opening.

It is a particular advantage of the invention that a stack which can be processed further is formed irrespective of whether the sheets are proof sheets, reject sheets or other sheet products, in particular, for example, a board with a number of blanks.

Formation of a particularly good stack is achieved by the fact that the sheets deposited on the auxiliary stack are deposited at a lower speed than the speed operated by the sheet-processing machine. As a result of this measure, a stack with precise edges can be formed, which is suitable for further processing, for example in a punching machine.

In accordance with a particularly advantageous feature of the invention, in the region of the ejection of a sheet from the sheet stream, part of the guide surface can be moved into the path of the sheet conveyance, so that part of the guide surface for the discharge of the sheet operates as a separating element during the sheet ejection. Forming the separating element as a rake facilitates interaction with grippers disposed in a row of a sheet transport system, for example of a chain gripper system.

In accordance with a concomitant feature of the invention, a further part of the guide surface is disposed so that it can be pivoted in such a way that firstly, it enlarges the opening out of the planar guide surface toward a braking belt and secondly, at the same time also forms a guide surface for the ejection path.

Other features which are considered as characteristic for the invention are set forth in the appended claims.

Although the invention is illustrated and described herein as embodied in an apparatus for ejecting sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
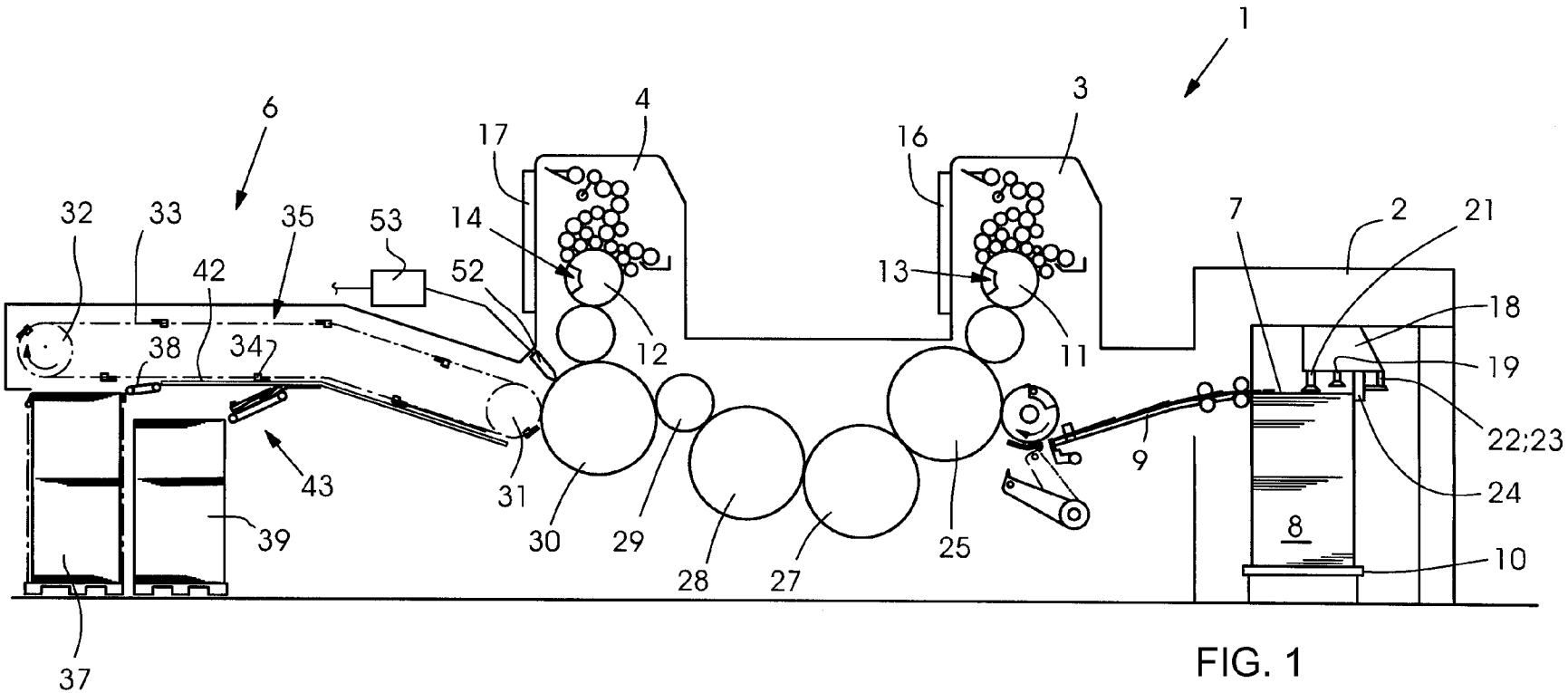
FIG. 1 is a diagrammatic, longitudinal-sectional view of a sheet-processing printing machine.

Referring now to the figures of the drawings in detail and first, particularly, to FIG. 1 thereof, there is seen a machine, e.g. a printing press 1, for processing sheets 7. The machine has a feeder 2, at least one printing unit 3, 4 and a delivery 6. The sheets 7 are removed from a sheet stack 8 and are fed, separated or overlapping, over a feed table 9 to the printing units 3, 4. The printing units 3, 4 each contain a plate cylinder 11, 12, in a known manner. The plate cylinders 11, 12 each have a device 13, 14 for fixing flexible printing plates. Furthermore, each plate cylinder 11, 12 is assigned a device 16, 17 for fully automatic or semiautomatic printing plate changing. A turning device is disposed between two impression cylinders 25, 30 and has a transfer drum 27, a storage drum 28 and a turning drum 29.

The sheet stack 8 rests on a stack board 10 that can be raised under control. The sheets 7 are removed from the top of the sheet stack 8 through the use of what is known as a suction head 18 which, inter alia, has a number of lifting and dragging suckers 19, 21 for separating the sheets 7. Furthermore, blowing devices 22 for loosening the upper sheet layers and sensing elements 23 for stack tracking are provided. A number of side and rear stops 24 is provided in order to align the sheet stack 8, in particular the upper sheets 7 of the sheet stack 8.

The delivery 6 has a sheet discharge system 35 in the form of a chain delivery, with gripper bars 34 for holding the leading edge of the sheet. The gripper bars 34 are disposed on two chains 33 disposed in parallel and guided endlessly around chain wheels 31, 32. A sheet braking or retarding system 38, for example in the form of a suction belt, is disposed upstream of a sheet delivery stack 37.

Figure 2:
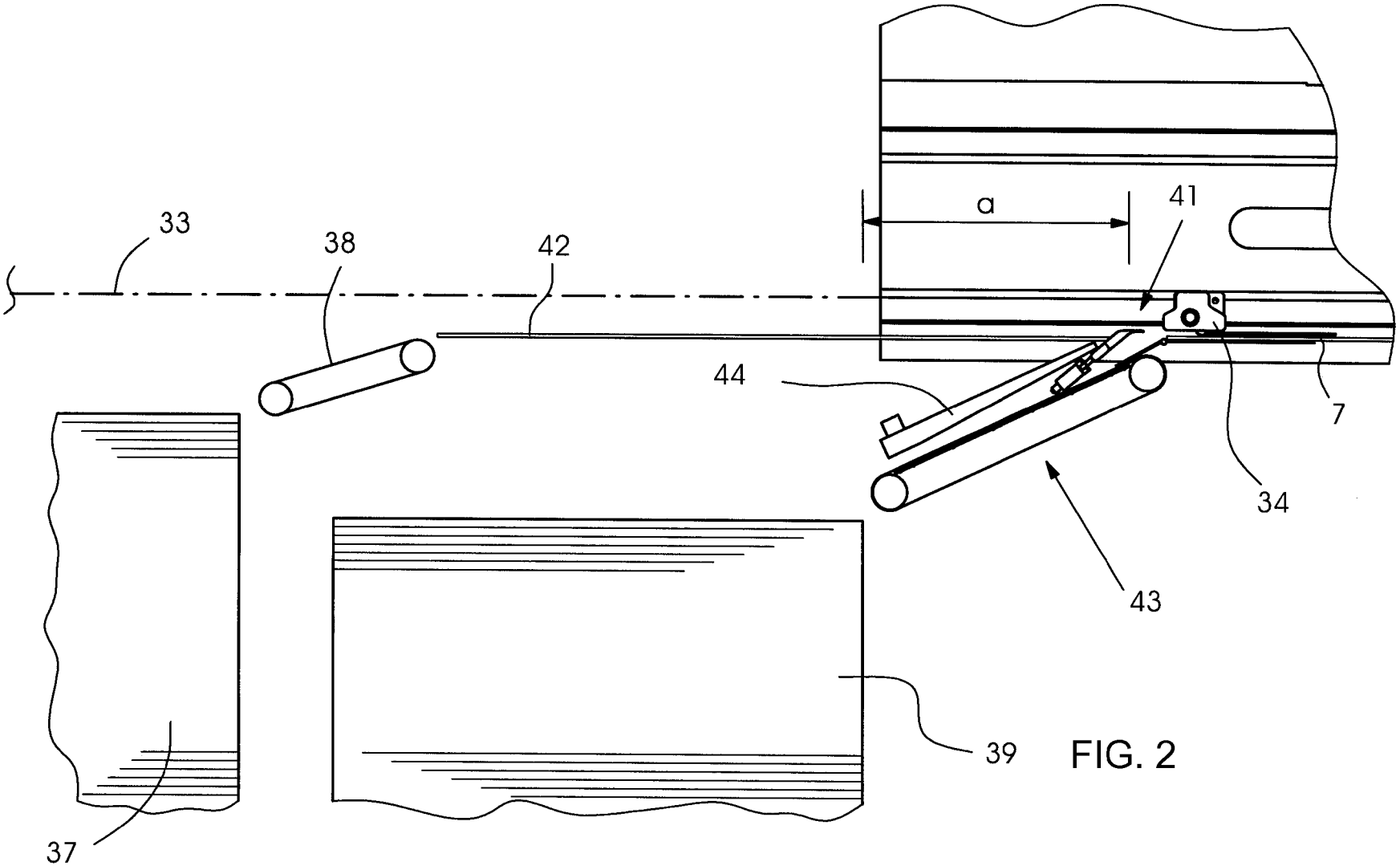
FIG. 2 is an enlarged, fragmentary, longitudinal-sectional view of a delivery of the sheet-processing machine.
Figure 5:
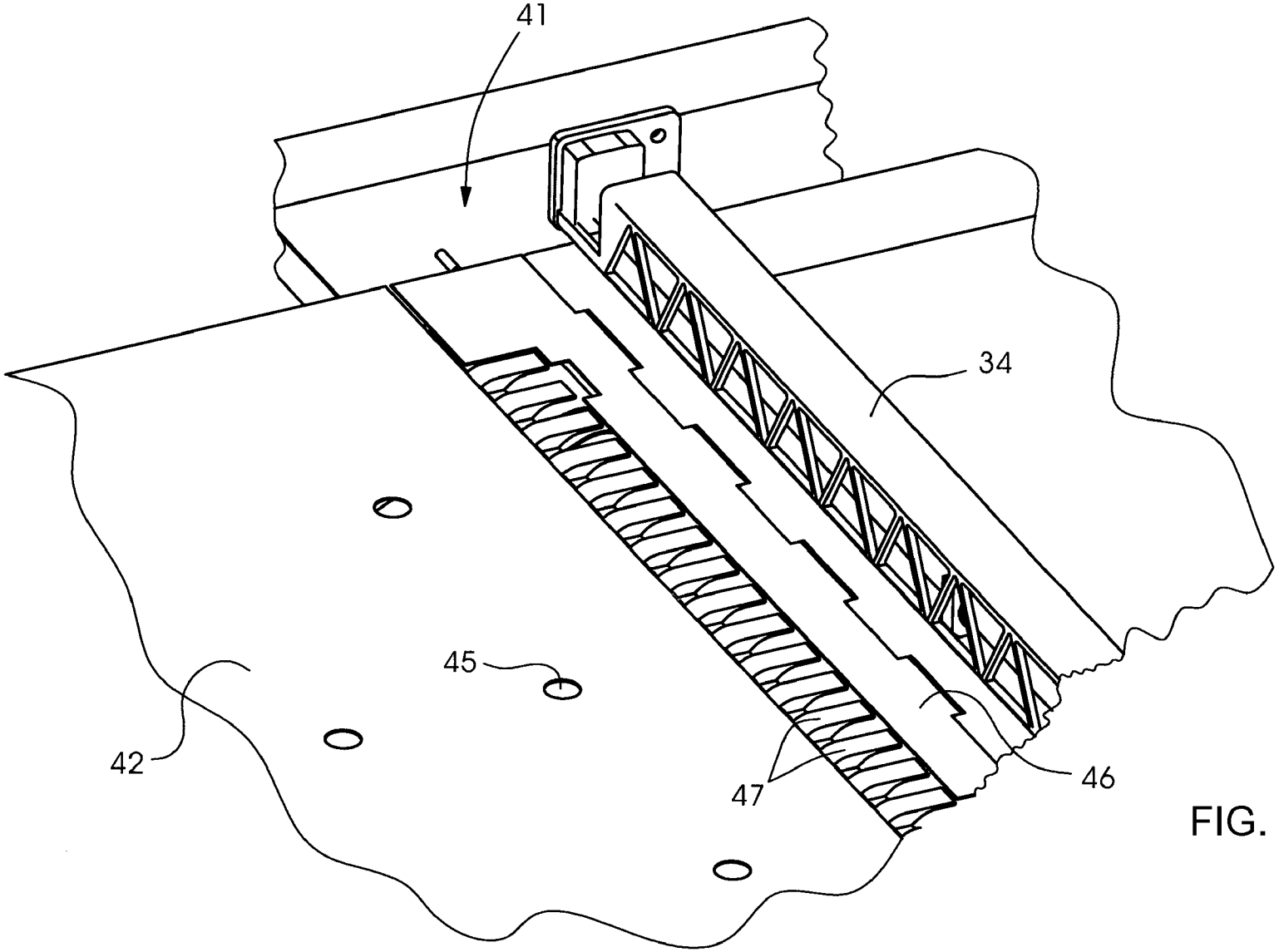
FIG. 5 is a top-perspective view of the closed ejection region.

In order to eject sheets 7 onto an auxiliary stack 39 disposed upstream of the main sheet stack 37, as is seen in a sheet transport direction, provision is made, according to FIG. 2, to place an ejection opening 41 in a guide plane or planar guide surface 42 of the sheet discharge system 35. The sheet guide device or planar guide surface 42 is formed by a number of sheet guide plates, which can have blowing nozzles 45 for the purpose of smear-free sheet guidance, as is seen in FIG. 5.

The ejection opening 41 is disposed at a distance a upstream of the auxiliary stack 39. A further sheet braking or retarding system 43, for example in the form of a suction belt, is disposed between the ejection opening 41 and a rear edge of the auxiliary stack 39.

A blower box 44 disposed at a short distance above the suction belt 43 ensures a good contact pressure of the sheet 7 on the suction belt 43.

Figure 3:
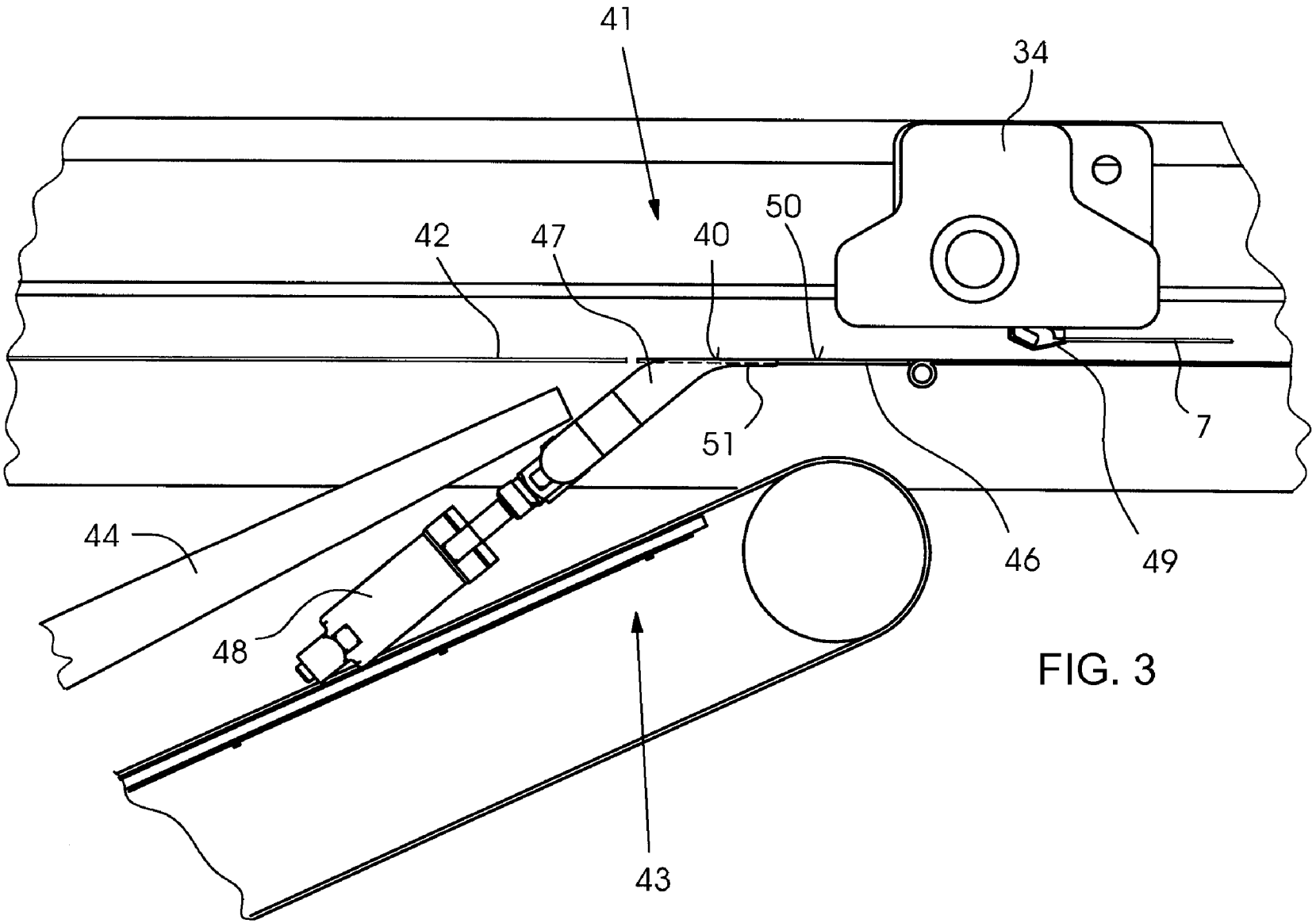
FIG. 3 is a further enlarged, fragmentary, longitudinal-sectional view of an ejection region in standard operation.

FIG. 3 shows the ejection opening 41 being closed in the planar guide surface 42. The ejection opening 41 is closed firstly by a flap 46 that is disposed in such a way that it can be pivoted and secondly by a separating element 47 for the sheets 7 to be ejected. An upper side 50 of the flap 46 and an upper side 40 of the separating element 47 provide guide surfaces which lie in one plane with the planar guide surface 42. The separating element 47 is disposed in such a way that it can be displaced through the use of an actuator 48, for example in the form of a pneumatically acting operating cylinder and, in the closed state of the ejection opening 41, its upper side 40 forms part of the planar guide surface 42.

Figure 4:
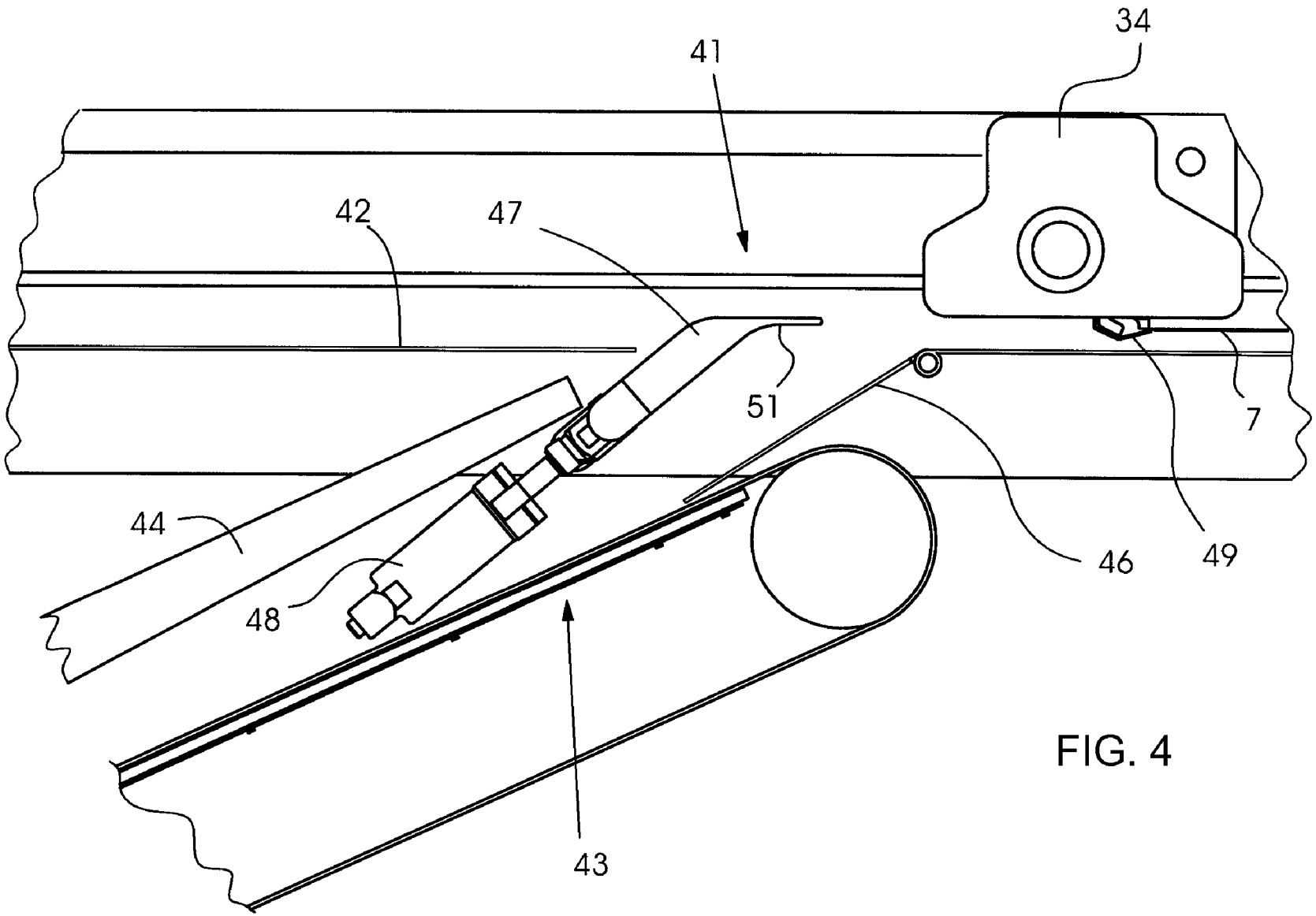
FIG. 4 is a view similar to FIG. 3 of the ejection region in ejection operation.

FIG. 4 shows the ejection opening 41 being open, with the flap 46 having been pivoted downward and its upper side 50 thus forming a guide surface for the ejected sheets 7. The separating element 47 in this position has been moved so far out by the actuator 48 that it projects above the planar guide surface 42, to be precise until it is above the leading edge of the sheet held by grippers 49 of the gripper bar 34.

The separating element 47 is formed as a rake, so that it has appropriate gaps which cooperate with the grippers 49 of the gripper bar 34 without contact. An underside 51 providing a guide surface of the separating element 47 has a concavely molded rounding, which forms a good guide for the leading edge of the ejected sheets 7.

An ejection of reject or proof sheets can either be carried out manually or automatically by using a sheet inspection apparatus 52. The sheet inspection apparatus 52 performs so-called vision control and is preferably disposed in the area of the last impression cylinder 30. The sheet inspection apparatus 52 is equipped with ink density and register detection and conducts appropriate measured values to a control computer 53. A desired-actual value comparison by the control computer 53 leads to the flap 46 being opened in the event of corresponding deviations, with the separating rake 47 being extended and the grippers 49 being opened. As a result of these measures, the sheet is released and ejected. In this case, the sheet firstly reaches the suction belt 43 and from there reaches the auxiliary stack 39 in a braked condition.

Of course, the auxiliary stack 39 can also be formed when it involves neither reject nor proof sheets but other printed products provided for further processing.

The invention claimed is:

1. An apparatus for ejecting sheets from a sheet transport path, the apparatus comprising:

a sheet deposit stack;

a sheet discharge system for transporting the sheets to said sheet deposit stack; and a sheet guide device with an ejection opening formed therein, said sheet guide device having a flap and a separating element in vicinity of said ejection opening, said flap being pivotable and having a guide surface for guiding the sheets both during discharge of the sheets and during ejection of the sheets.

2. The apparatus according to claim 1, wherein said separating element is displaceable and has both a guide surface for guiding the sheets during discharge of the sheets and a guide surface for ejection of the sheets.

3. The apparatus according to claim 1, which further comprises a braking belt disposed downstream of said ejection opening, and an auxiliary stack disposed downstream of said braking belt.

4. The apparatus according to claim 3, wherein said braking belt is a suction belt.

5. The apparatus according to claim 4, which further comprises a blower box associated with said braking belt.

6. The apparatus according to claim 1, wherein the apparatus for ejecting sheets is a sheet-processing machine.

7. The apparatus according to claim 6, wherein the sheet-processing machine is a rotary printing press.

* * * * *